US010354789B2

(12) United States Patent
Wu et al.

(10) Patent No.: US 10,354,789 B2
(45) Date of Patent: Jul. 16, 2019

(54) CHOKE

(71) Applicant: CYNTEC CO., LTD., Hsinchu (TW)

(72) Inventors: Tsung-Chan Wu, Hsinchu County (TW); Roger Hsieh, Hsinchu County (TW); Yi-Min Huang, Hsinchu (TW); Lan-Chin Hsieh, Kaohsiung (TW); Yu-Ching Kuo, Miaoli County (TW)

(73) Assignee: CYNTEC CO., LTD., Hsinchu (TW)

( * ) Notice: Subject to any disclaimer, the term of this patent is extended or adjusted under 35 U.S.C. 154(b) by 178 days.

(21) Appl. No.: 14/102,510

(22) Filed: Dec. 11, 2013

(65) Prior Publication Data

US 2014/0097931 A1 Apr. 10, 2014

Related U.S. Application Data

(63) Continuation of application No. 13/331,786, filed on Dec. 20, 2011, now Pat. No. 9,208,937, which is a continuation-in-part of application No. 12/709,912, filed on Feb. 22, 2010, now Pat. No. 8,212,641.

(30) Foreign Application Priority Data

Feb. 27, 2009 (TW) ..... 98106464 A

(51) Int. Cl.
*H01F 27/24* (2006.01)
*H01F 27/255* (2006.01)
*H01F 17/04* (2006.01)

(52) U.S. Cl.
CPC ..... *H01F 27/255* (2013.01); *H01F 17/045* (2013.01); *H01F 2017/048* (2013.01)

(58) Field of Classification Search
CPC . H01F 27/255; H01F 17/045; H01F 2017/048
USPC ..... 336/233, 178, 212, 221
See application file for complete search history.

(56) References Cited

U.S. PATENT DOCUMENTS 4,391,864 A * 7/1983 Hosaka et al. ..... 428/844.7
4,913,959 A * 4/1990 Miyake et al. ..... 428/329
6,198,373 B1 * 3/2001 Ogawa et al. ..... 336/83
6,348,850 B1 * 2/2002 Kimura et al. ..... 336/200
6,362,436 B1 * 3/2002 Kimbara ..... H01L 23/13 174/256

(Continued)

FOREIGN PATENT DOCUMENTS

JP 2002096607 A * 4/2002
JP 2003297642 * 10/2003

(Continued)

*Primary Examiner* — Mang Tin Bik Lian
*Assistant Examiner* — Kazi S Hossain
(74) *Attorney, Agent, or Firm* — Min-Lee Teng; Litron Patent & Trademark Office

(57) ABSTRACT

An electronic device including a core, at least a wire and a magnetic material is provided. The core includes a pillar, a top board and a bottom board. The pillar is disposed between the top board and the bottom board. An area of the top board is smaller than an area of the bottom board. A winding space is formed among the top board, the bottom board and the pillar. The wire is winded around the pillar and located in the winding space. The magnetic material fills the winding space to encapsulate the wire. The magnetic material includes a resin and a metallic powder, wherein an average particle diameter of the magnetic powder is smaller than 20 μm.

7 Claims, 8 Drawing Sheets

(56) References Cited

U.S. PATENT DOCUMENTS

| | | | | |
|---|---|---|---|---|
| 7,209,022 | B2 * | 4/2007 | Kuroiwa | H01F 17/045 336/200 |
| 2002/0113680 | A1 * | 8/2002 | Kato | H01F 17/04 336/83 |
| 2002/0180353 | A1 * | 12/2002 | Kuromitsu | H01J 9/242 313/582 |
| 2003/0048167 | A1 * | 3/2003 | Inoue | H01F 17/0013 336/200 |
| 2003/0071704 | A1 * | 4/2003 | Toi et al. | 336/83 |
| 2005/0048347 | A1 * | 3/2005 | Takashita | H01M 8/0204 429/457 |
| 2007/0159282 | A1 * | 7/2007 | Huang | H01F 27/255 336/83 |
| 2008/0055034 | A1 * | 3/2008 | Tsunemi et al. | 336/83 |
| 2008/0100410 | A1 * | 5/2008 | Tomita | C22C 1/0433 336/233 |
| 2008/0231406 | A1 * | 9/2008 | Lin | H01F 27/292 336/200 |
| 2010/0026444 | A1 * | 2/2010 | Lee | H01F 27/365 336/84 M |

FOREIGN PATENT DOCUMENTS

| | | | |
|---|---|---|---|
| JP | 2006327053 | A * | 12/2006 |
| JP | 2009174993 | A * | 8/2009 |

* cited by examiner

CHOKE

CROSS-REFERENCE TO RELATED APPLICATION

This application is a continuation of U.S. application Ser. No. 13/331,786, which is a continuation in part of U.S. application Ser. No. 12/709,912, which claims the priority benefit of Taiwan application serial no. 98106464, filed on Feb. 27, 2009. The entirety of the above-mentioned patent application is hereby incorporated by reference herein and made a part of specification.

BACKGROUND OF THE INVENTION

1. Field of the Invention

The present invention relates to a choke. More particularly, the present invention relates to a choke having a relatively small height and size.

2. Description of Related Art

A choke is used for stabilizing a circuit current to achieve a noise filtering effect, and a function thereof is similar to that of a capacitor, by which stabilization of the current is adjusted by storing and releasing electrical energy of the circuit. Compared to the capacitor that stores the electrical energy by an electrical field (electric charge), the choke stores the same by a magnetic field.

In the past, the chokes are generally applied in electronic devices such as DC/DC converters and battery chargers, and applied in transmission devices such as modems, asymmetric digital subscriber lines (ADSL) or local area networks (LAN), etc. However, in recent years, with development and demands of electronics technology, various electronic products are continually developed, and have a general trend of lightness, slimness, shortness and smallness. The chokes are widely applied to information products such as notebooks, mobile phones, LCD displays, and digital cameras, etc. Though, a height and size of the choke can be a problem in utilization.

FIG. 1 is a cross-sectional view of a conventional choke. Referring to FIG. 1, the choke 10 has a coil 12 and a magnetic material 14 encapsulating the coil 12, wherein a shape size of the choke 10 is above 4 mm×4 mm, and a height thereof is above 2.5 mm. A method of fabricating the choke 10 is as follows. First, a wire is winded into the coil 12, and the winded coil 12 is disposed in a mold. Next, the magnetic material 14 fills in the mold for encapsulating the coil 12, wherein the magnetic material 14 is, for example, insulated magnetic powder with particles. Next, a pressure molding and a firing process are performed to form the choke 10.

In the fabrication process of the choke 10, since the magnetic material 14 has the particles, and the coil 12 is a hollow structure, during the pressure molding process, the particles of the magnetic material 14 can press the coil 12 under the pressure, so that the coil 12 can be cracked or deformed. Moreover, if the height of the choke 10 is reduced to be less than or equal to 2.5 mm, a relatively fine wire (especially having high inductance) can be applied to wind the coil 12. However, the coil 12 winded by such fine wire has a poor strength, and the pressure molding cannot be performed, so that reduction of the size of the choke 10 cannot be implemented.

FIG. 2 is a cross-sectional view of another conventional choke. Referring to FIG. 2, the choke 20 disclosed by the U.S. Pat. No. 7,209,022 includes a drum-core 30, a wire 40, an exterior resin 50, and a pair of external electrodes 60. The drum-core 30 includes a pillar 32, a top board 34 and a bottom board 36, and the pillar 32, the top board 34 and the bottom board 36 form a winding space S. The wire 40 is winded around the pillar 32, and is located in the winding space S. The exterior resin 50 fills in the winding space S, and encapsulates the wire 40, wherein the exterior resin 50 is coated by a dispenser, and a glass transition temperature that the exterior resin 50 is transited from a glass state to a plastic state is below −20° C. The pair of external electrodes 60 is disposed on a lower surface of the bottom board 36.

Since the exterior resin 50 of the choke 20 has a volatile solvent, and is a mixed material formed by a plurality of formulations, after it is coated in the winding space S, it has to be rested at a room temperature for 30 minutes to vaporize the solvent, so as to perform a heat-curing process. Therefore, a fabrication time of the choke 20 is relatively long. Moreover, since the exterior resin 50 is formed by a plurality of the formulations having the solvent, and the glass transition temperature is below −20° C., a pot-life and a heat time of the exterior resin 50 are influenced by a formulation ratio, so that the pot-life of the exterior resin 50 is shortened, and a part of the formulations cannot be used for a mass production.

SUMMARY OF THE INVENTION

The present invention is directed to a choke having a magnetic material that can be directly heat-cured without being rested in a room temperature for some time, so as to shorten a fabrication time.

The present invention provides an electronic device including a core, at least a wire and a magnetic material. The core includes a pillar, a top board and a bottom board. The pillar is disposed between the top board and the bottom board. An area of the top board is smaller than an area of the bottom board. A winding space is formed among the top board, the bottom board and the pillar. The wire is winded around the pillar and located in the winding space. The magnetic material fills the winding space to encapsulate the wire. The magnetic material includes a resin and a metallic powder, wherein an average particle diameter of the magnetic powder is smaller than 20 μm.

In an embodiment of the present invention, the average particle diameter of the magnetic powder is smaller than or equal to 12 μm.

In an embodiment of the present invention, the average particle diameter of the magnetic powder is smaller than or equal to 7 μm.

In an embodiment of the present invention, the average particle diameter of the magnetic powder is smaller than or equal to 5 μm.

In an embodiment of the present invention, the shape of the magnetic powder is substantially a circle.

The present invention provides a choke including a drum-core, at least a wire and a magnetic material. The drum-core includes a pillar, a top board and a bottom board. The pillar is disposed between the top board and the bottom board. An area of the top board is smaller than that of the bottom board. A winding space is formed among the top board, the bottom board and the pillar. The wire is winded around the pillar and is located in the winding space. The magnetic material fills the winding space and encapsulates the wire. The magnetic material includes a thermosetting resin and a metallic powder, wherein a viscosity of the thermosetting resin is between 12000 c.p.s. and 30000 c.p.s., and a content of the metallic powder in the magnetic material is between 60 wt % and 80 wt %.

In an embodiment of the present invention, the top board and the bottom board of the drum-core are respectively a quadrate board. The top board has a first upper surface and a first lower surface, and the bottom board has a second upper surface and a second lower surface. The pillar is a column, and a diameter of the pillar is less than a length of a side of the top board.

In an embodiment of the present invention, a height between the first upper surface and the second lower surface is H, a height between the first lower surface and the second upper surface is h, and $0.3 \leq h/H \leq 0.5$.

In an embodiment of the present invention, a length of a side of the top board is L1, a length between a side of the top board and an adjacent side of the pillar is L2, and $0.2 \leq L2/L1 \leq 0.3$.

In an embodiment of the present invention, a diameter of the wire is d, a height between the first lower surface and the second upper surface is h, and $d \leq h/2$.

In an embodiment of the present invention, a height between the first lower surface and the second upper surface is h, a length between a side of the top board and an adjacent side of the pillar is L2, and $h \leq L2 \leq 3h$.

In an embodiment of the present invention, the bottom board has at least two arc-shaped guide slots and two bar-shaped guide slots respectively connected to the arc-shaped guide slots.

In an embodiment of the present invention, the arc-shaped guide slots are located at two opposite sides of the bottom board.

In an embodiment of the present invention, the choke further includes a pair of electrodes and a solder paste. The pair of electrodes and the solder paste are respectively disposed on the bar-shaped guide slots, wherein the pair of electrodes is formed by laminated metal layers, two ends of the wire are disposed on the pair of electrodes, and the solder paste covers the wire.

In an embodiment of the present invention, the choke further includes a pair of electrodes, and the pair of electrodes only covers a middle region of the bar-shaped guide slots.

In an embodiment of the present invention, the choke further includes a pair of electrodes, and the pair of electrodes only covers two ends of the bar-shaped guide slots.

In an embodiment of the present invention, the drum-core is formed by pressure molding a ferrite powder.

In an embodiment of the present invention, a material of the drum-core includes Ni—Zn ferrite or Mn—Zn ferrite, and the metallic powder includes an iron powder.

In an embodiment of the present invention, a permeability of the magnetic material is between 4 and 6.

In an embodiment of the present invention, the thermosetting resin is an organic material of polymer, and does not contain a volatile solvent.

In an embodiment of the present invention, the thermosetting resin includes a polymethylallyl (PMA) synthesize resin.

In an embodiment of the present invention, a linear expansion coefficient of the thermosetting resin is between $1\times10^{-5}/°$ C. and $20\times10^{-5}/°$ C.

In an embodiment of the present invention, a glass transition temperature of the thermosetting resin is between 130° C. and 170° C.

In an embodiment of the present invention, a content of the magnetic powder in the magnetic material is between 50 wt % and 90 wt %.

In an embodiment of the present invention, a glass transition temperature of the magnetic material and a glass transition temperature of the thermosetting resin are substantially the same.

The present invention provides a choke including a drum-core, at least a wire and a magnetic material. The drum-core includes a pillar and a winding space. The wire is winded around the pillar and is located in the winding space. The magnetic material fills the winding space and encapsulates the wire. The magnetic material includes a thermosetting resin and a metallic powder, wherein a viscosity of the thermosetting resin is between 12000 c.p.s. and 30000 c.p.s., and a content of the metallic powder in the magnetic material is between 60 wt % and 80 wt %.

The present invention further provides a choke including a core, at least a wire and a magnetic material. The core includes a pillar and a winding space. The wire is winded around the pillar and located in the winding space. The magnetic material fills in the winding space, encapsulating the wire and includes a resin and a magnetic powder, wherein an average particle diameter of the magnetic powder is smaller than 20 μm.

In an embodiment of the present invention, the magnetic powder comprises an iron powder and the iron powder in the magnetic material is between 50 wt % and 90 wt %.

In an embodiment of the present invention, the magnetic powder comprises an iron powder and the iron powder in the magnetic material is between 50 wt % and 90 wt %, and the magnetic powder is void of ferrite.

In an embodiment of the present invention, an electronic device is disclosed, wherein the electronic device comprises: a core comprising a pillar and a winding space; at least a wire, winded around the pillar and located in the winding space; and a magnetic material, filling the winding space and encapsulating the wire, wherein the magnetic material comprises resin and magnetic powder, wherein the magnetic powder comprises iron powder, wherein a content of the iron powder in the magnetic material is between 50 wt % and 90 wt %. In one embodiment, the electronic device as described above, the magnetic powder is void of ferrite.

In an embodiment of the present invention, an electronic device, comprising: a core comprising a pillar and a winding space; at least a wire, winded around the pillar and located in the winding space; and a magnetic material, filling the winding space and encapsulating the wire, wherein the magnetic material comprises resin and magnetic powder, wherein the magnetic powder comprises metallic powder, wherein the magnetic powder is void of ferrite and a content of the metallic powder in the magnetic material is between 50 wt % and 90 wt %. In one embodiment, the electronic device as described above, the content of the metallic powder in the magnetic material is between 60 wt % and 80 wt %.

In the present invention, since the choke applies the magnetic material formed by the thermosetting resin and the iron powder, after the magnetic material is coated in the winding space, it can be directly heat-cured without being rested in the room temperature for some time. Compared to the conventional technique, not only the fabrication time of the choke can be shortened, but also cracking and deforming of the drum-core can be avoided after the magnetic material is heated. Moreover, the magnetic material is also suitable for a mass production.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the embodiment of the invention, an electronic device including a core, at least a wire and a magnetic material is provided. The electronic device is a choke, for example. The core includes a pillar, a top board and a bottom board. The pillar is disposed between the top board and the bottom board. An area of the top board is smaller than an area of the bottom board. A winding space is formed among the top board, the bottom board and the pillar. The wire is winded around the pillar and located in the winding space. The magnetic material fills the winding space to encapsulate the wire. The magnetic material includes a resin and a metallic powder, wherein an average particle diameter of the magnetic powder is smaller than 20 μm. The resin includes a thermosetting resin, for example.

Moreover, the average particle diameter of the magnetic powder is smaller than or equal to 12 μm. In more detail, the average particle diameter of the magnetic powder is smaller than or equal to 7 μm. Perfectly, the average particle diameter of the magnetic powder is smaller than or equal to 5 μm, and the average particle diameter of the magnetic powder includes peak values of Gaussian Distribution. The shape of the magnetic powder is substantially a circle. It should be noted that magnetic powder of small mean particle diameter is, the better effects of the inductance value of the electronic device will be. The following embodiment uses a choke as an example, and persons of ordinary skill in the art may make modifications to the embodiments of the electronic device of the present invention without departing from the spirit of the present invention.

Figure 3:
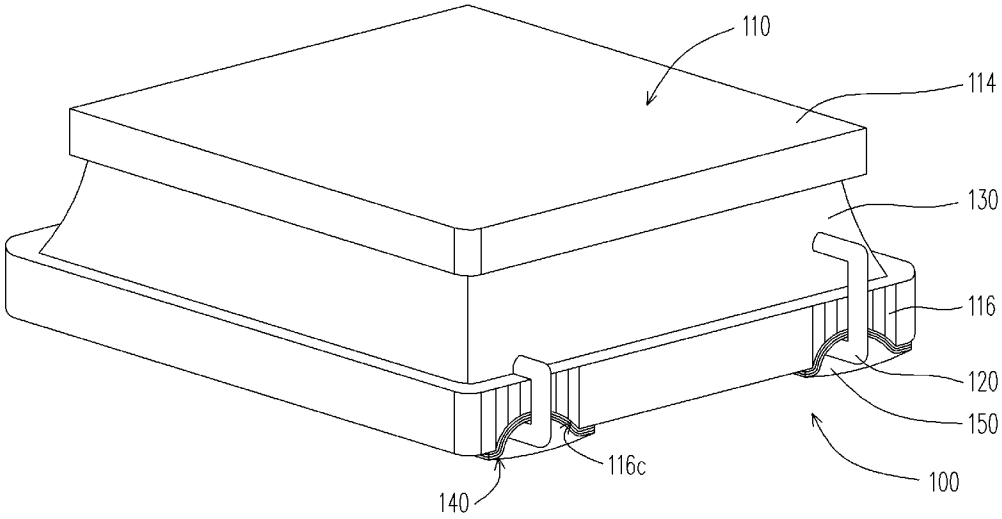
FIG. 3 is a three-dimensional view of a choke according to an embodiment of the present invention.
Figure 4:
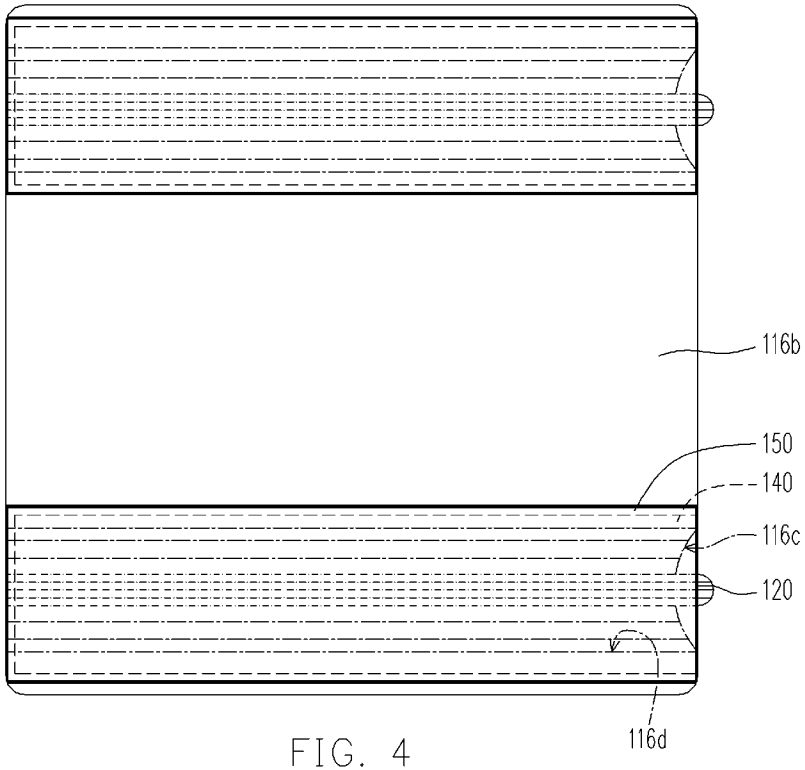
FIG. 4 is a bottom view of a choke depicted in FIG. 3.
Figure 5:
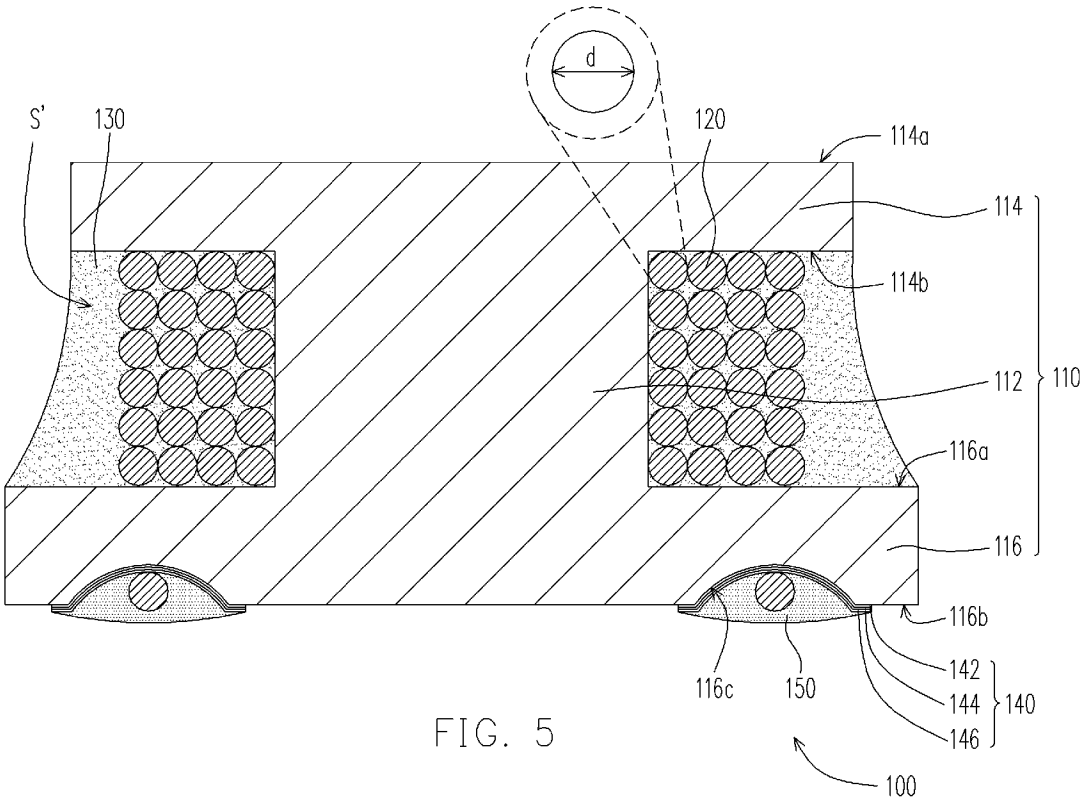
FIG. 5 is a cross-sectional view of a choke depicted in FIG. 3.
Figure 6:
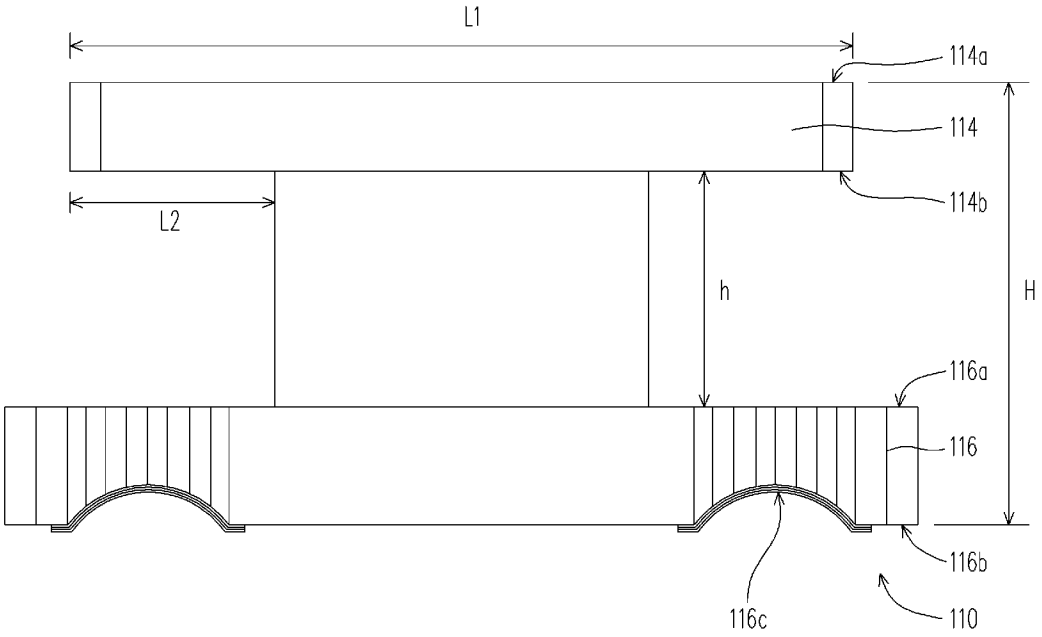
FIG. 6 is a front view of a drum-core of a choke depicted in FIG. 3.

FIG. 3 is a three-dimensional view of a choke according to an embodiment of the present invention, FIG. 4 is a bottom view of the choke depicted in FIG. 3, FIG. 5 is a cross-sectional view of the choke depicted in FIG. 3, and FIG. 6 is a front view of a drum-core of the choke depicted in FIG. 3. Referring to FIG. 3, FIG. 4 and FIG. 5, in the present embodiment, the choke 100 includes a drum-core 110, at least a wire 120 (only one is illustrated in FIG. 5) and a magnetic material 130. The choke 100 is suitable for a small size application, for example, a shape size of the chock 100 is below 4 mm×4 mm, and a height thereof is below 2.5 mm.

In detail, the drum-core 110 includes a pillar 112, a top board 114 and a bottom board 116, wherein the pillar 112 is disposed between the top board 114 and the bottom board 116, and a winding space S' is formed among the top board 114, the bottom board 116 and the pillar 112. The pillar 112, the top board 114 and the bottom board 116 can be formed integrally, or can be respectively fabricated, and then are integrated by adhesion or locking. Particularly, in the present embodiment, the drum-core 110 is formed by pressure molding and firing an adhesive mixed with a ferrite powder. Namely, the pillar 112, the top board 114 and the bottom board 116 are formed integrally. Moreover, the ferrite powder includes Ni—Zn ferrite powder or Mn—Zn ferrite powder. Preferably, in the present embodiment, the drum-core 110 is formed by the Ni—Zn ferrite powder. The adhesive includes a polymethylallyl (PMA) synthesize resin, and a linear expansion coefficient thereof is between $1\times10^{-5}$/° C. and $20\times10^{-5}$/° C. In the present embodiment, the linear expansion coefficient is about $13.8\times10^{-5}$/° C.

According to a design of the choke 100 of the present embodiment, the top board 114 and the bottom board 116 are respectively a quadrate board, wherein an area of the top board 114 is smaller than that of the bottom board 116. Namely, a side length of the top board 114 is smaller than that of the bottom board 116. In detail, referring to FIG. 6, the top board 114 has a first upper surface 114*a* and a first lower surface 114*b*, and the bottom board 116 has a second upper surface 116*a* and a second lower surface 116*b*, wherein the a height H is between the first upper surface 114*a* and the second lower surface 116*b*, and a height h is between the first lower surface 114*b* and the second upper surface 116*a*, and preferably $0.3\leq h/H\leq 0.5$, though the present embodiment is not limited thereto. Moreover, the side length of the top board 114 is L1, a length L2 is between a side of the top board 114 and an adjacent side of the pillar 112, and preferably $0.2\leq L2/L1\leq 0.3$, though the present embodiment is not limited thereto.

Referring to FIG. 5 and FIG. 6 again, the wire 120 of the choke 100 is winded around the pillar 112, and is located in the winding space S', wherein the wire 120 is formed by a copper wire coated with an enamelled layer, and the enamelled layer is an insulating layer. The wire 120 can be linear or spiral. In the present embodiment, the pillar 112 is a column, and two ends of the pillar 112 are respectively connected to the first lower surface 114*b* and the second upper surface 116*a*, wherein a diameter of the pillar 112 is less than the side length of the top board 114. Since the pillar 112 is a column, when the wire 120 is winded around the pillar 112, besides the wire 120 can be attached to an outer wall of the pillar 112 to effectively wind the wire 120, a relatively low direct current resistance (DCR) can also be obtained under an equivalent permeability effect.

Further, a diameter of the wire 120 is d (including a diameter of the copper wire and a thickness of the enamelled layer), and the height of the pillar 112 (i.e. a distance between the first lower surface 114*b* and the second upper surface 116*a*) is h. Preferably, $d\leq h/2$, though the present embodiment is not limited thereto. In brief, in a design of the present embodiment, a size of the winding space S' is defined according to the above equation $0.3\leq h/H\leq 0.5$ or $0.2\leq L2/L1\leq 0.3$, and a relation between the diameter d of the wire 120 and the winding space S' can be defined by $d\leq h/2$ and $h\leq L2\leq 3h$, though the present embodiment is not limited thereto.

Figure 1:
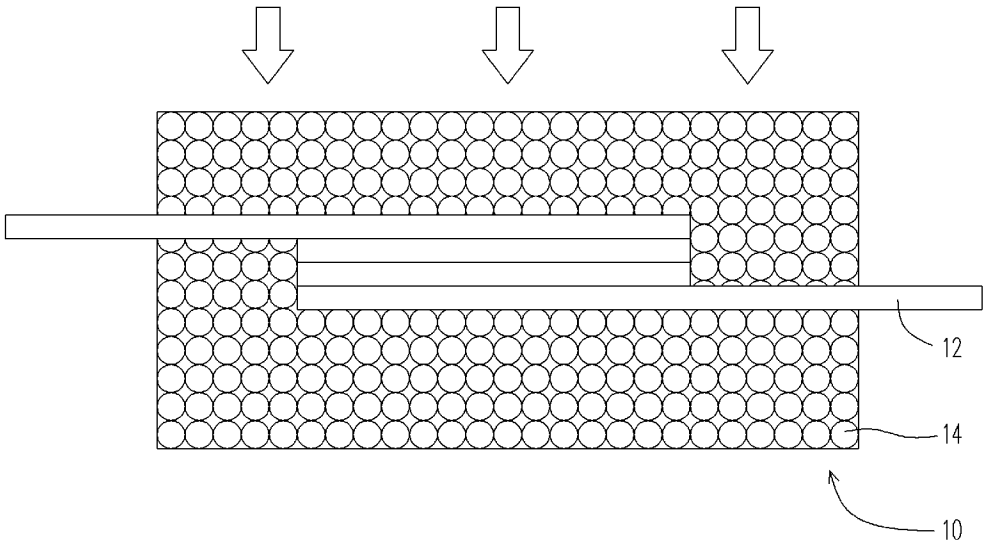
FIG. 1 (PRIOR ART)
FIG. 1 is a cross-sectional view of a conventional choke.

During the fabrication of the choke 100 of the present embodiment, the pillar 112, the top board 114 and the bottom board 116 are first formed, and then the wire 120 is winded around the pillar 112. Compared to the conventional technique that the coil 12 is first winded, and then the magnetic material 14 and the coil 12 are pressure-molded to form the choke 10 (referring to FIG. 1), in the present embodiment, cracking or deforming of the coil 12 caused by the coil 12 being pressed by the particles of the magnetic material 14 during the pressure-molding process can be avoided.

Moreover, an overall height and the size of the choke 100 are related to the height and the size of the drum-core 110, while the height and the size of the conventional choke 10 are related to the diameter of the coil 12 and an amount of the filled magnetic material 14. During the fabrication of the choke 100 of the present embodiment, the drum-core 110 is first formed, and then the wire 120 is winded, so that compared to the conventional fabrication method that the wire is first winded to form the coil 12, and then the magnetic material 14 fills and pressure-molded to formed the choke 10, the overall height and size of the choke 100 can be accurately controlled.

Figure 7:
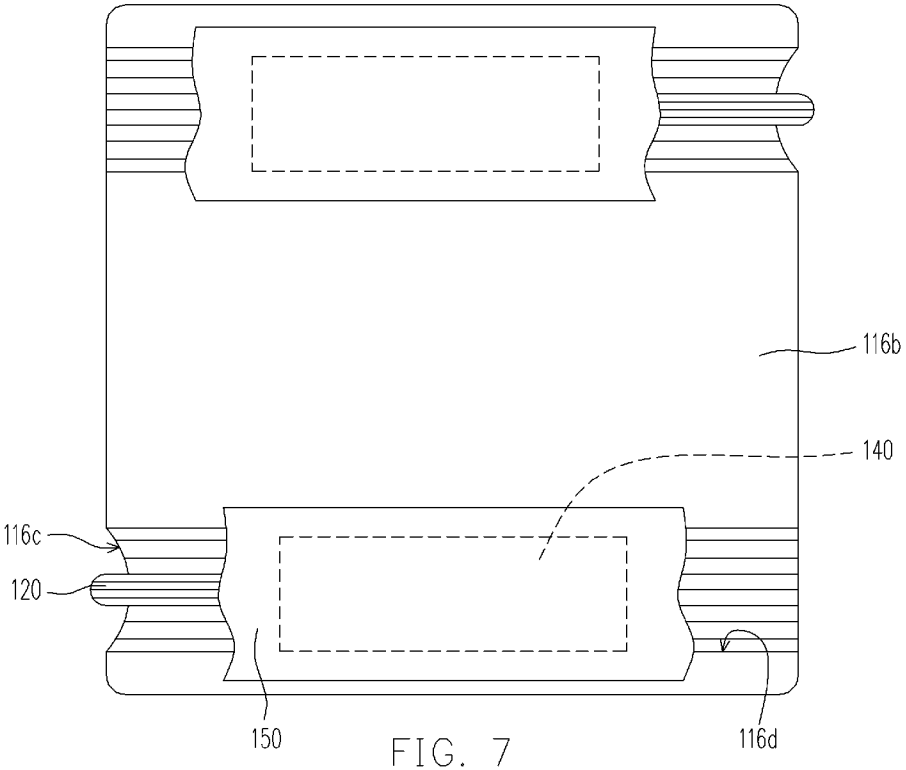
FIG. 7 is another bottom view of a drum-core of a choke depicted in FIG. 3.
Figure 8:
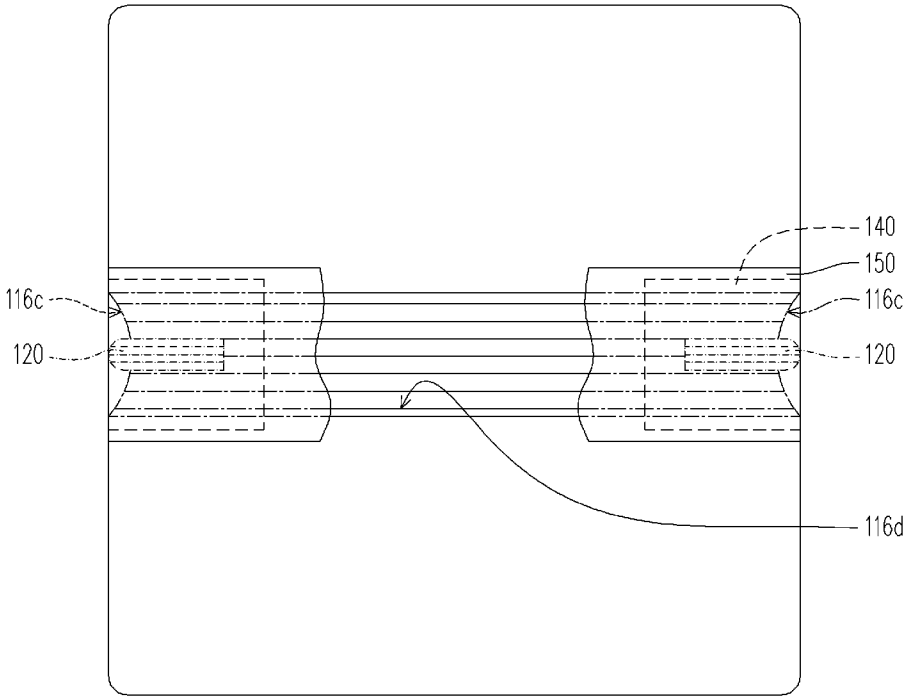
FIG. 8 is still another bottom view of a drum-core of a choke depicted in FIG. 3.

Referring to FIG. 3, FIG. 4 and FIG. 5, in the present embodiment, the bottom board 116 further has two arc-shaped guide slots 116*c* and two bar-shaped guide slots 116*d* respectively connected to the arc-shaped guide slots 116*c*. The arc-shaped guide slots 116*c* are located at a same side of the bottom board 116 (referring to FIG. 4) or two opposite sides of the bottom board 116 (referring to FIG. 7 and FIG. 8). The arc-shaped guide slots 116*c* connect the second upper surface 116*a* and the second lower surface 116*b*, and the bar-shaped guide slots 116*d* are disposed on the second lower surface 116*b*. Particularly, in the present embodiment, longitudinal sections of the arc-shaped guide slot 116*c* and longitudinal sections of the bar-shaped guide slots 116*d* are all ladder-shaped.

Moreover, in the present embodiment, the choke 100 further includes a pair of electrodes 140. The pair of electrodes 140 is disposed on the second lower surface 116*b*, wherein the pair of electrodes 140 is formed by laminated metal layers, while the metal layer is formed by, for example, coating, and the laminated metal layers include a silver paste 142 serving as a base material, a nickel layer 144 formed by electroplating, and a tin layer 146 formed by electroplating. The pair of electrodes 140 can be respectively disposed on the bar-shaped guide slots 116*d* and the second lower surface 116*b* at two sides of the bar-shaped guide slots 116*d*, wherein the electrode 140 covers the whole bar-shaped guide slot 116*d* (referring to FIG. 4), only covers a middle region of the bar-shaped guide slot 116*d* (referring to FIG. 7) or covers two ends of the bar-shaped guide slot 116*d* (referring to FIG. 8). Two ends of the wire 120 can be respectively bended to the bar-shaped guide slots 116*d* along the arc-shaped guide slots 116*c*, and can be disposed on the pair of electrodes 140 to electrically connect the pair of electrodes 140. Then, a solder paste 150 can be soldered to cover the wire 120, so as to fix the wire 120 on the bar-shaped guide slots 116*d*. The choke 100 is suitable for electrically connecting to external through the pair of electrodes 140 on the bottom board 116 according to a surface mount technology (SMT). Since the electrode 140 of the present invention is formed by laminating a plurality of metal layers on the bar-shaped guide slot 116*d*, compared to the conventional technique that applies a lead frame as an electrode, the height of the choke 100 of the present invention is not increased since the electrode 140 is disposed in the bar-shaped guide slot 116*d*. Regarding a choke with a relatively small size, the conventional fabrication method that applies the lead frame may have a problem of uneasy soldering between the lead frame and the wire. However, in the present invention, the electrodes are formed by directly coating the metal layers, and then the wire 120 is covered by the solder paste 150 for electrically connecting the wire 120 and the electrode 140, so that the uneasy soldering problem between the lead frame and the wire can be resolved.

In the present embodiment, since the bar-shaped guide slots 116*d* are designed on the bottom board 116, besides the pair of electrodes 140 can be directly fabricated on the bar-shaped guide slots 116*d*, the wire 120 can also be fixed on the bar-shaped guide slots 116*d*, so that the overall height of the choke 100 can be effectively controlled. Moreover, the electrode 140 is disposed on the bar-shaped guide slot 116*d* and extends to the second lower surface 116*b* located at two sides of the bar-shaped guide slot 116*d*, which may avail forming the nickel layer 144 and the tin layer 146 by electroplating process, and avails the solder paste 150 protruding out from the second lower surface 116*b*, so as to facilitate an external electrical connection. In addition, the longitudinal section of the bar-shaped guide slot 116*d* is arc-shaped, so that the silver paste 142 can be sufficiently coated in the bar-shaped guide slot 116*d*, and a problem that corners of the bar-shaped guide slot 116*d* are difficult to be coated with the silver paste 142 is avoided.

Referring to FIG. 3 and FIG. 5 again, in the present embodiment, the magnetic material 130 fills in the winding space S' and encapsulates the wire 120, wherein the magnetic material 130 fills in the winding space S' by coating. The magnetic material 130 is composed of a thermosetting resin and a metallic powder, wherein the thermosetting resin is an organic material not containing volatile solvent, and a viscosity of the thermosetting resin is between 12000 c.p.s. and 30000 c.p.s. A content of the metallic powder in the magnetic material 130 is between 50 wt % and 90 wt %, perfectly, is between 60 wt % and 80 wt %, and a content of the thermosetting resin is less than 40 wt %. In one embodiment, the content of the metallic powder in the magnetic material 130 is between 50 wt % and 90 wt %, perfectly, is between 60 wt % and 80 wt %, and the magnetic material 130 is void of ferrite.

In the present embodiment, the viscosity of the thermosetting resin is between 12000 c.p.s. and 18000 c.p.s., and the metallic powder includes an iron powder.

In detail, a reason that the thermosetting resin and the iron powder are used to compose the magnetic material 130 lies in: the thermosetting resin can bear a high temperature of more than 350° C. when a heating temperature exceeds a glass transition temperature, so as to satisfy a demand of a desolder temperature, and a permeability of the magnetic material 130 can be easily controlled due to utilization of the iron powder. Moreover, since the viscosity of the thermosetting resin is between 12000 c.p.s. and 30000 c.p.s., the iron powder is easy to be mixed with the thermosetting resin to form the magnetic material 130, and a tolerance range of a mixing ratio thereof is relatively great, and the thermosetting resin is easy to be coated in the winding space S'. Since a content of the thermosetting resin in the magnetic material 130 is less than 40 wt %, and the thermosetting resin does not contain the volatile solvent, during a heat-curing process, a thermal stress generated due to expansion and contraction of the thermosetting resin can be reduced, and blow holes are relatively less, so that cracking of the drum-core 110 can be avoided. In addition, in the present embodiment, the permeability of the magnetic material 130 is between 4 and 6, and the thermosetting resin is a polymer, for example, a polymethylallyl (PMA) synthesize resin, wherein a linear expansion coefficient of the thermosetting resin is between $1\times10^{-5}$/° C. and $20\times10^{-5}$/° C., and the glass transition temperature is between 130° C. and 170° C. In one embodiment, the content of the iron powder in the magnetic material 130 is between 50 wt % and 90 wt %, perfectly, is between 60 wt % and 80 wt %, and the magnetic material 130 is void of ferrite.

Particularly, in the present embodiment, the glass transition temperature of the magnetic material 130 is substantially the same to the glass transition temperature of the thermosetting resin, and the linear expansion coefficient is about $13.8\times10^{-5}$/° C., and the glass transition temperature is 150° C.

Since the top board 114 and the bottom board 116 of the drum-core 110 of the present embodiment are all quadrate boards, and an area of the top board 114 is less than that of the bottom board 116, and the viscosity of the magnetic material 130 is between 12000 c.p.s. and 30000 c.p.s., and the content of the thermosetting resin 130 is less than 40 wt %, after the magnetic material 130 is filled in the winding space S' by coating, a flash phenomenon of the magnetic material 130 is not liable to be occurred.

It should be noted that since the magnetic material 130 of the present embodiment does not contain the volatile solvent, after the magnetic material 130 is coated, it can be directly heat-cured without being rested in the room temperature for some time, and cracking and deforming of the drum-core can be avoided when the magnetic material 130 is heat-cured, so that compared to the conventional technique, not only a fabrication time of the choke 100 can be shortened, but also a pot-life of the magnetic material 130 is not influenced by a formulation ratio, and the magnetic material 130 is suitable for a mass production.

Moreover, in the drum-core 110 of the present embodiment, the top board 114 and the bottom board 116 are designed to be quadrate, so that not only the choke 100 may have a relatively high permeability effect, but also the DCR can be reduced, and a saturation current can be increased. Moreover, in the present embodiment, since the pair of electrodes 140 is designed on the second lower surface 116*b* of the bottom board 116, and the bottom board 116 is the quadrate board, when the choke 100 is electrically connected to the external through the pair of electrodes 140 on the bottom board 116, a positioning and a direction-selecting problem can be avoided, and the choke 100 can be directly connected to the external according to the SMT without using the lead frame. By such means, not only the choke 100 may have a relatively small overall height, but also a designable size of the drum-core 110 can be increased.

In brief, in the present embodiment, since the choke 100 applies the magnetic material 130 composed of the thermosetting resin and the metallic powder, after the magnetic material 130 is coated in the winding space S', it can be directly heat-cured without being rested in the room temperature for some time. Compared to the conventional technique, not only the fabrication time of the choke 100 can be shortened, but also cracking and deforming of the drum-core can be avoided after the magnetic material 130 is heated. Moreover, a pot-life of the magnetic material 130 is not influenced by the formulation ratio, and the magnetic material 130 is suitable for a mass production.

Experiment

In the present invention, since an inductance, the DCR and the saturation current of the choke 100 are all related to winding turns that the wire 120 wraps around the pillar 112, the diameter of the wire 120 (the diameter of the copper wire and the thickness of the enamelled layer), and the size of the drum-core 110, three groups of measured results are provided below for comparing relations among the winding turns of the wire 120 and the diameter of the wire 120, and the inductance, the DCR and the saturation current.

Figure 2:
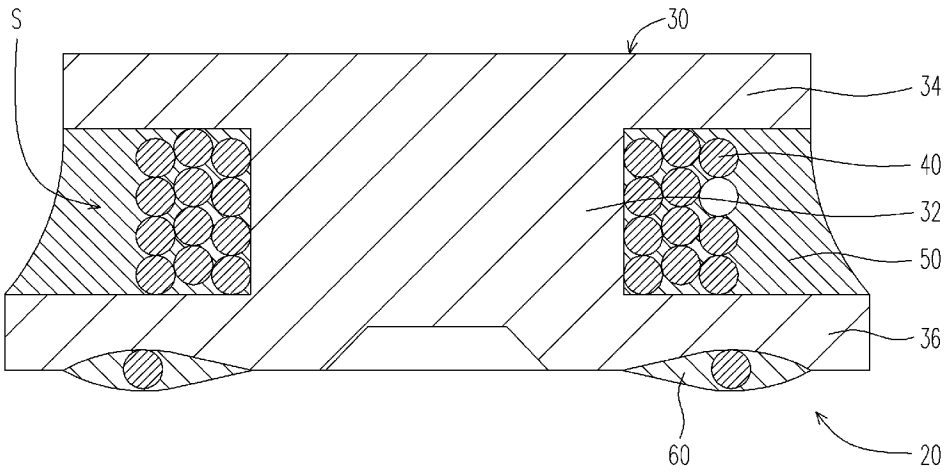
FIG. 2 (PRIOR ART)
FIG. 2 is a cross-sectional view of another conventional choke.

In the present embodiment, the three groups of measured results are all obtained by comparing the drum-cores 30 and 110 of the chokes 20 and 100 with the same material and similar size, wherein a difference between the choke 100 of the present embodiment and the choke 20 of FIG. 2 is that the magnetic material 130 used by the choke 100 does not contain the volatile solvent, and the magnetic material 130 is composed of the thermosetting resin and the iron powder, though the magnetic material 30 used by the choke 20 of FIG. 2 contains the volatile solvent, and is formed according to a plurality of formulations. It should be noted that the following three groups of measured results are all obtained in case that no cracking is occurred to the drum-cores 30 and 110 during the heat-curing process.

TABLE ONE

| DR-core serial No. (3 × 3 × 1.0) | | Winding method (mm/turns) | Inductance (μH) | DCR (mΩ) | Saturation current (30%) |
|---|---|---|---|---|---|
| 2R2 | Choke20 | ψ0.12/7.5T | 2.2 | 95 | 1100 |
| | Choke100 | | 2.4 | 83 | 1342 |
| 3R3 | Choke20 | ψ0.11/9.5T | 3.3 | 140 | 870 |
| | Choke100 | | 3.4 | 122 | 1188 |
| 4R7 | Choke20 | ψ0.1/10.5T | 4.7 | 190 | 750 |
| | Choke100 | | 4.9 | 163 | 975 |
| 6R8 | Choke20 | ψ0.09/12.5T | 6.8 | 300 | 610 |
| | Choke100 | | 6.5 | 231 | 808 |
| 10R0 | Choke20 | ψ0.09/15.5T | 10.0 | 450 | 500 |
| | Choke100 | | 9.6 | 308 | 760 |

In detail, the table one presents the experiment and calculation data of two chokes 20 and 100 having a size of 3 mm×3 mm×1 mm and respectively applying five different wire diameters and winding turns, wherein the data includes the inductances, the DCRs and the saturation currents. According to the data of the table one, in case of the same wire diameter and the same winding turns, the choke 100 has a relatively better DCR and saturation current. Namely, compared to the choke 20, the choke 100 has advantages of the low DCR and the high saturation current. Moreover, in case of the same wire diameter and different winding turns, the inductances and the DCRs of the chocks 20 and 100 are all proportional to the winding turns, and the saturation currents of the chocks 20 and 100 are all inversely proportional to the winding turns.

TABLE TWO

| DR-core serial No. (3 × 3 × 1.2) | | Winding method (mm/turns) | Inductance (μH) | DCR (mΩ) | Saturation current (30%) | Temperature increase (40° C.) |
|---|---|---|---|---|---|---|
| 2R2 | Choke20 | ψ0.11/6.5T | 2.2 | 80 | 1100 | 1200 |
| | Choke100 | | 2.5 | 72 | 1173 | 1900 |
| 3R3 | Choke20 | ψ0.11/8.5T | 3.3 | 100 | 910 | 1050 |
| | Choke100 | | 3.4 | 96 | 1021 | 1700 |
| 4R7 | Choke20 | ψ0.11/10.5T | 4.7 | 130 | 770 | 980 |
| | Choke100 | | 4.9 | 119 | 875 | 1300 |
| 6R8 | Choke20 | ψ0.09/11.5T | 6.8 | 190 | 670 | 740 |
| | Choke100 | | 6.8 | 168 | 756 | 1100 |
| 10R0 | Choke20 | ψ0.09/15.5T | 10.0 | 290 | 540 | 630 |
| | Choke100 | | 9.26 | 231 | 614 | 1000 |

In detail, the table two presents the experiment and calculation data of two chokes 20 and 100 having a size of 3 mm×3 mm×1.2 mm and respectively applying five different wire diameters and winding turns, wherein the data includes the inductances, the DCRs and the saturation currents. According to the data of the table two, in case of the same wire diameter and the same winding turns, the choke 100 has a relatively better DCR and saturation current. Namely, compared to the choke 20, the choke 100 has advantages of the low DCR and the high saturation current. Moreover, when the temperature in increased for 40° C., an increment of the saturation current of the choke 100 is greater than that of the choke 20. Namely, compared to the choke 20, the choke 100 has a better saturation current. Moreover, in case of the same wire diameter and different winding turns, the inductances and the DCRs of the chocks 20 and 100 are all proportional to the winding turns, and the saturation currents of the chocks 20 and 100 are all inversely proportional to the winding turns.

TABLE THREE

| DR-core serial No. (4 × 4 × 1.2) | | Winding method (mm/turns) | Inductance (μH) | DCR (mΩ) | Saturation current (30%) |
|---|---|---|---|---|---|
| 2R2 | Choke20 | ψ0.14/5.5T | 2.2 | 90 | 1650 |
| | Choke100 | | 2.29 | 56.6 | 1407.7 |
| 3R3 | Choke20 | ψ0.13/6.5T | 3.3 | 130 | 1200 |
| | Choke100 | | 3.24 | 78.5 | 1231.4 |
| 4R7 | Choke20 | ψ0.13/8.5T | 4.7 | 140 | 1050 |
| | Choke100 | | 4.588 | 107.2 | 1110.7 |
| 6R8 | Choke20 | ψ0.11/9.5T | 6.8 | 180 | 900 |
| | Choke100 | | 6.87 | 149.6 | 765.7 |

In detail, the table three presents the experiment and calculation data of two chokes 20 and 100 having a size of 4 mm×4 mm×1.2 mm and respectively applying four different wire diameters and winding turns, wherein the data includes the inductances, the DCRs and the saturation currents. According to the data of the table three, in case of the same wire diameter and the same winding turns, the choke 100 has a relatively better DCR and saturation current. Namely, compared to the choke 20, the choke 100 has advantages of the low DCR and the high saturation current. Moreover, in case of the same wire diameter and different winding turns, the inductances and the DCRs of the chocks 20 and 100 are all proportional to the winding turns, and the saturation currents of the chocks 20 and 100 are all inversely proportional to the winding turns.

In brief, according to the experiment data, it is known that in case of the drum-cores 30 and 110 of the chokes 20 and 100 applying the same material, and having the similar size, and the wire diameter and the winding turns being the same, and in case that only the magnetic material 130 used by the choke 100 does not contain the volatile solvent, and the magnetic material 130 is composed of the thermosetting resin and the iron powder, though the magnetic material 30 used by the choke 20 of FIG. 2 contains the volatile solvent, and is formed according to a plurality of formulations, compared to the choke 20, the choke 100 has the better DCR and the saturation current.

In summary, since the choke of the present invention applies the magnetic material composed of the thermosetting resin and the metallic powder, the choke of the present invention has at least the following advantages:

1. After the magnetic material is coated in the winding space, it can be directly heat-cured without being rested in the room temperature for some time, so as to shorten the fabrication time of the choke.

2. When the magnetic material is heated, cracking or deforming of the drum-core can be avoided.

3. A pot-life of the magnetic material is not influenced by a formulation ratio, so that the magnetic material is suitable for a mass production.

4. A content of the thermosetting resin in the magnetic material is less than 40 wt %, so that during the heat-curing process, a thermal stress generated due to expansion and contraction of the thermosetting resin can be reduced, and cracking of the drum-core can be avoided.

5. The inductance, the shape size, the saturation current and the DCR of the choke all meet a required specification.

6. The choke is suitable for applications that require a shape size of the choke being below 4 mm×4 mm and a height being below 1.5 mm.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a core comprising a top board having a bottom surface, a bottom board having a top surface and a pillar, wherein the pillar is disposed between the bottom surface of the top board and the top surface of the bottom board and a winding space surrounding the pillar is formed between the bottom surface of the top board and the top surface of the bottom board, wherein said core is made of a first magnetic material comprising ferrite;

a wire, wound around the pillar and located in the winding space; and a molding body, encapsulating the wire in the winding space, said molding body surrounding the pillar of the core and being made of a second magnetic material comprising thermosetting resin and iron powder, wherein the second magnetic material is void of ferrite and a content of the iron powder in the second magnetic material is between 60 wt % and 90 wt % relative to a total weight of the second magnetic material comprising thermosetting resin and iron powder, wherein a content of the thermosetting resin in the second magnetic material is not greater than 40 wt % relative to said total weight of the second magnetic material, wherein said molding body made of said second magnetic material being void of ferrite is entirely encompassed between the bottom surface of the top board and the top surface of the bottom board.

2. The electronic device as claimed in claim 1, wherein an average particle diameter of the iron powder is smaller than 20 μm.

3. The electronic device as claimed in claim 1, wherein a linear expansion coefficient of the thermosetting resin is between $1\times10^{-5}$/° C. and $20\times10^{-5}$/° C.

4. The electronic device as claimed in claim 1, wherein a glass transition temperature of the thermosetting resin is between 130° C. and 170° C.

5. The electronic device as claimed in claim 1, wherein a viscosity of the thermosetting resin is between 12000 c.p.s. and 30000 c.p.s.

6. The electronic device as claimed in claim 1, wherein a glass transition temperature of the second magnetic material and a glass transition temperature of the thermosetting resin are substantially the same.

7. The electronic device as claimed in claim 1, wherein an area of the top board is smaller than an area of the bottom board.

* * * * *